US008230886B2

(12) United States Patent
Wang

(10) Patent No.: US 8,230,886 B2
(45) Date of Patent: Jul. 31, 2012

(54) SWEATBAND AND CAP HAVING THE SAME

(75) Inventor: Tai-Kuang Wang, Taipei (TW)

(73) Assignee: Zhongshan Wei Li Textile Co., Ltd., Zhongshan, Guang Dong Province (CN)

( * ) Notice: Subject to any disclaimer, the term of this patent is extended or adjusted under 35 U.S.C. 154(b) by 252 days.

(21) Appl. No.: 12/701,403

(22) Filed: Feb. 5, 2010

(65) Prior Publication Data

US 2011/0191937 A1 Aug. 11, 2011

(51) Int. Cl.
*D03D 7/00* (2006.01)
*D03D 17/00* (2006.01)
*D03D 15/08* (2006.01)
*D03D 25/00* (2006.01)

(52) U.S. Cl. ..... 139/421; 139/383 R; 139/420 R; 139/422

(58) Field of Classification Search ..... 139/383 R, 139/420 R, 421, 422
See application file for complete search history.

(56) References Cited

U.S. PATENT DOCUMENTS 1,823,034 A * 9/1931 Dworsky et al. ..... 442/182
1,950,559 A * 3/1934 Solomon ..... 139/421
2,379,574 A * 7/1945 Goldthwait ..... 8/125
3,221,736 A * 12/1965 Heitzmann ..... 602/44
4,207,885 A * 6/1980 Hampton et al. ..... 602/76
4,234,022 A * 11/1980 Okamoto et al. ..... 139/420 R
4,282,906 A * 8/1981 Black ..... 139/422
5,694,981 A * 12/1997 Stanhope et al. ..... 139/383 R
5,749,400 A * 5/1998 Pascual ..... 139/421
5,858,885 A * 1/1999 Hamilton et al. ..... 442/184
5,874,372 A * 2/1999 Morishita et al. ..... 442/182
6,336,224 B1 * 1/2002 Wang ..... 2/195.3
6,637,181 B1 * 10/2003 Korte et al. ..... 57/200
6,659,139 B2 * 12/2003 Laycock et al. ..... 139/422
6,705,353 B2 * 3/2004 Hotta et al. ..... 139/421
7,000,553 B1 * 2/2006 Wang ..... 112/475.11
7,143,790 B2 * 12/2006 Liao ..... 139/421
7,299,828 B2 * 11/2007 Liao ..... 139/421
7,572,744 B1 * 8/2009 Ikenaga et al. ..... 442/182
7,762,287 B2 * 7/2010 Liao ..... 139/422
7,841,369 B1 * 11/2010 Osborne ..... 139/421
7,886,776 B2 * 2/2011 Jung et al. ..... 139/421
2002/0079015 A1 * 6/2002 Gotta et al. ..... 139/421
2003/0024592 A1 * 2/2003 Serillon ..... 139/421
2003/0136459 A1 * 7/2003 Laycock et al. ..... 139/421
2003/0159749 A1 * 8/2003 Hotta et al. ..... 139/421
2003/0221234 A1 * 12/2003 Wang ..... 2/12

(Continued)

OTHER PUBLICATIONS

"sweatband." Collins English Dictionary—Complete & Unabridged 10th Edition. HarperCollins Publishers. Jan. 20, 2012. <Dictionary.com http://dictionary.reference.com/browse/sweatband>.*

*Primary Examiner* — Bobby Muromoto, Jr.
(74) *Attorney, Agent, or Firm* — Cheng-Ju Chiang

(57) ABSTRACT

A cap includes a bill portion, a body formed by a plurality of gores, and a sweatband sewn on a lower edge of the body. The sweatband is substantially sewing-free among different sections and includes a third section connected to the bill portion, a second section connected to the first section which is made of uniaxial elastic fabric, and a first section connected to a portion of the body other than the bill portion. The second section is connected between the first section and the third section without a sewing portion.

17 Claims, 13 Drawing Sheets

U.S. PATENT DOCUMENTS

2003/0226192 A1* 12/2003 Wang ..... 2/183
2003/0226193 A1* 12/2003 Wang ..... 2/195.6
2004/0003450 A1* 1/2004 Wang ..... 2/181
2006/0112475 A1* 6/2006 Wang ..... 2/195.5
2006/0212993 A1* 9/2006 Wang ..... 2/171
2007/0022929 A1* 2/2007 Wang ..... 112/1
2007/0245456 A1* 10/2007 Cho ..... 2/181
2009/0260130 A1* 10/2009 Wang ..... 2/182.8
2010/0093258 A1* 4/2010 Glenn et al. ..... 450/86
2010/0154101 A1* 6/2010 Wang ..... 2/181.2
2011/0120588 A1* 5/2011 Shteiyer ..... 139/36
2011/0146832 A1* 6/2011 Hsu et al. ..... 139/420 R

* cited by examiner

SWEATBAND AND CAP HAVING THE SAME

BACKGROUND OF THE INVENTION

1. Field of the Invention

The present invention generally relates to a sweatband and a cap having the same. Particularly, the present invention relates to a sweatband including several sections without sewing portion and a cap having the same.

2. Description of the Prior Art

As time goes by, caps such as baseball caps or sport caps have been successively developed. The development of caps not only affects fashion style but also simplifies complicated equipments and complex manufacturing processes. Although caps include a variety of designs, most caps still have common feature. For example, the cap usually has a body including plural gores and a bill portion sewn on the front of the body. Since gores of certain caps are made of elastic fabrics, these caps of one size can fit people having different head sizes.

A traditional cap generally includes a sweatband sewn on the lower edge of the body. The sweatband is configured to define the body and appropriately fit the wearer's head. The sweatband also provides other functions such as absorbing and evaporating sweat. When the cap is designed to have elasticity, the sweatband is usually made of elastic material. Thus, the body and the sweatband can stretch to fit different head size when the cap is worn. U.S. Pat. Nos. 5,715,540, 6,493,880, 6,625,818, 5,966,742, and 6,016,572, for example, disclose that the sweatband is a circular band made of uniaxial or biaxial stretchable material. When the sweatband is sewn on the stretchable body to form a stretchable cap, the stretchable cap can fit people having different head sizes. In these prior arts, the sweatband includes a first section, a second section, and a third section. The first section partially overlaps the third section to form a sewing portion between the first section and the third section. When viewing from the top, the first section is on top of the third section, and a connection section is sewn on the overlapping portion, so that the connection between first section and the third section can be more firmly. However, such design has several defects. For example, since the overlapping portion between the first section and the third section will closely contact the wearer's head, such sewing portions will make the wearer feel uncomfortable due to frictions. Moreover, when viewing form the bottom, the exposed sewing threads are unattractive and affect the elasticity of the cap. Furthermore, those exposed threads on the sewing portions which contact the wearer's head very often are easily worn down and break causing the sweatband to be separated from the body. Meanwhile, in some cases, the sweatband is formed by folding the lower edge of the gores inwardly to save materials and the working hour. However, although such folding process may be cost effective, the cap still has several drawbacks. For example, since the gores are folded inwardly, the sewing portion among these gores will be exposed, so that the exposed threads will directly contact the wearer's head. Moreover, since the gores are folded inwardly, the folded portion becomes a protrusion on the sweatband. When contacting the wearer's head, the protrusion will make the wearer feel uncomfortable.

As shown in FIG. 1, U.S. Pat. No. 6,892,398 discloses a sweatband including a first section 110, a second section 116, and a third section 112, wherein the first section 110 and the second section 112 are directly connected to the third section without overlapping each other. That is, the first section 110 and the third section 112 are on the same level and connected by the second section 116. Although such design makes the second section 116 become flatter, the wearer sometimes will feel uncomfortable due to the seam among the first section 110, the second section 116, and the third section 112. Since the seam is exposed outside, the sewing threads are easily worn down resulting in the separation of the sweatband from the body.

Moreover, as the development of caps advances, the brand becomes more and more important. Consequently, the brand logo or company name is preferably presented on the outer surface or inner surface of the cap. In view of the drawbacks of the prior arts, it is required to provide a more comfortable, more appealing, and cost-effective cap.

SUMMARY OF THE INVENTION

It is an object of the present invention to provide a cost-effective, comfortable, and appealing cap. The cap includes a body, a bill portion, and a sweatband. The sweatband is a continuously woven sweatband without any sewing portion or seam among different sections. The sweatband includes an elastic first section, an elastic second section, and a third section free of elastic fibers. The sweatband can be connected to a body of a cap in two ways. One is that the third section free of elastic fiber and the elastic second section both are connected to the bill portion, and the elastic first section is connected to a portion of the body other than the bill portion. The other is that the third section free of elastic fibers is connected to the bill portion, while the elastic second section and the elastic first section are connected to a portion of the body other than the bill portion.

It is another object of the present invention to provide a continuously woven sweatband, which is substantially free of seams among different sections. The sweatband includes an elastic first section, an elastic second section, and a third section free of elastic fibers. The third section and the elastic first section can be woven by any suitable weaving process, while the weaving density of the elastic second section is larger than the weaving density of the first section. Compared to the prior art sweatband, the sweatband of the present invention is a continuously woven sweatband including three different sections without any seam therebetween. The third section of the sweatband is made of non-elastic fibers, so that the third section can be relatively thin and very ventilative. The second section and the first section can include elastic fibers and non-elastic fibers. The weaving process and the fiber count of the second section and the first section can be the same. The second section and the first section are different in that the weaving density of the second section is larger than the weaving density of the first section. Since the weaving density of the first section is less than the weaving density of the second section, the elasticity of the first section is higher than the elasticity of the second section.

DETAILED DESCRIPTION OF THE PREFERRED EMBODIMENT

Figure 1:
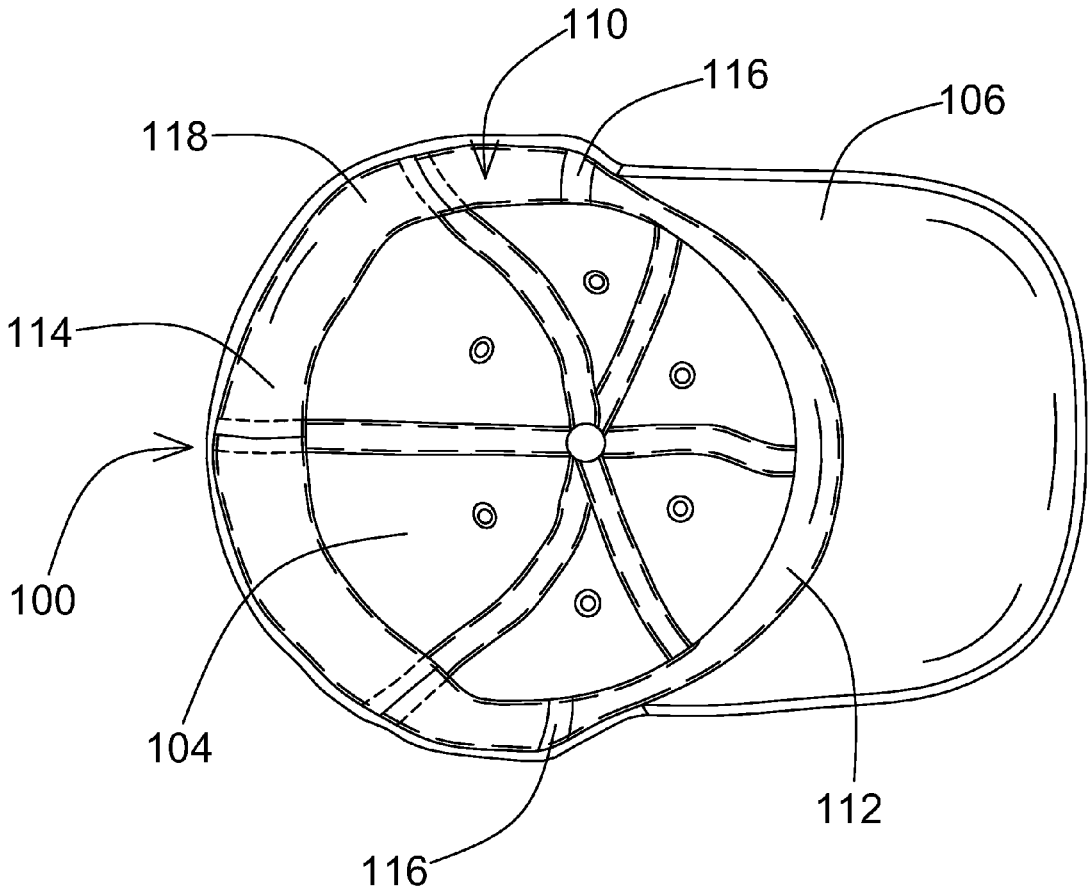
FIG.1 (PRIOR ART)
FIG. 1 shows a schematic view of a conventional sweatband.
Figure 2:
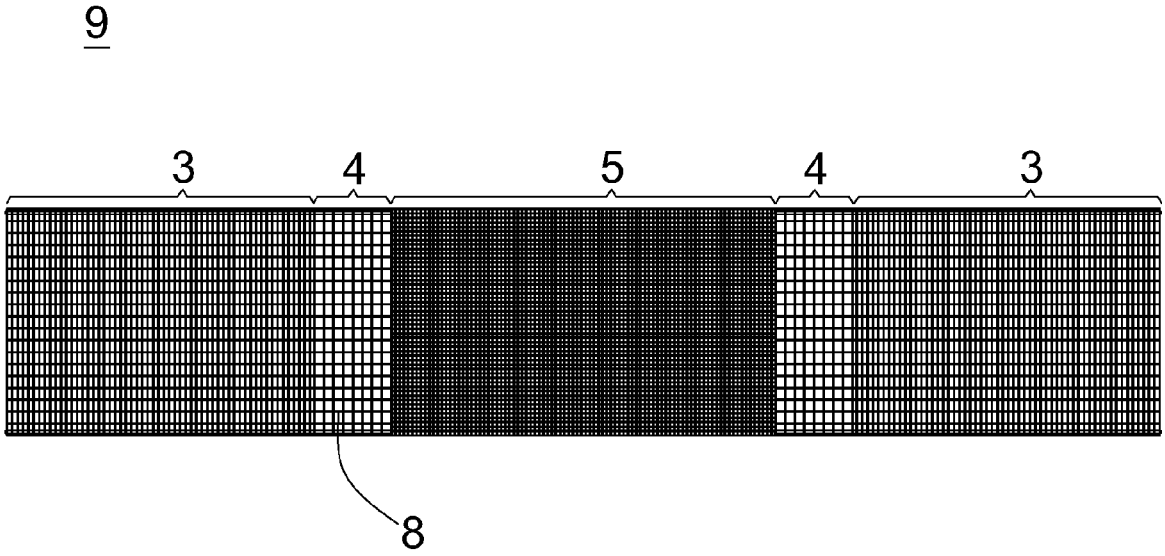
FIG. 2 shows a side view of an embodiment of a sewing-free sweatband.
Figure 3:
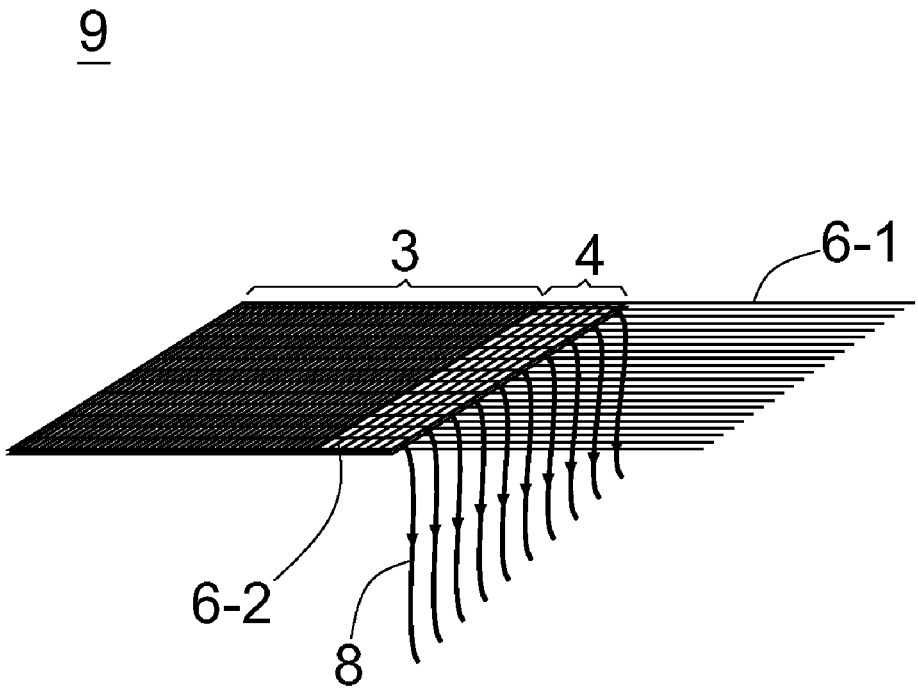
FIG. 3 shows a schematic view of separating the elastic fiber from the sweatband.
Figure 4:
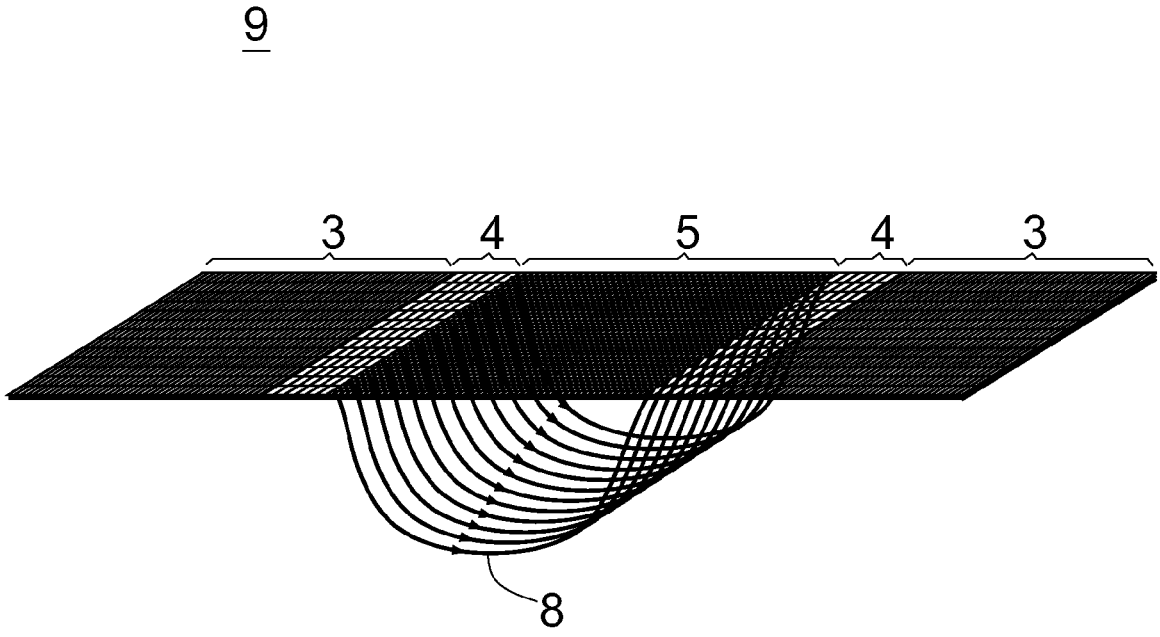
FIG. 4 shows a schematic view of rejoining the elastic fiber in a continuous weaving process.
Figure 5:
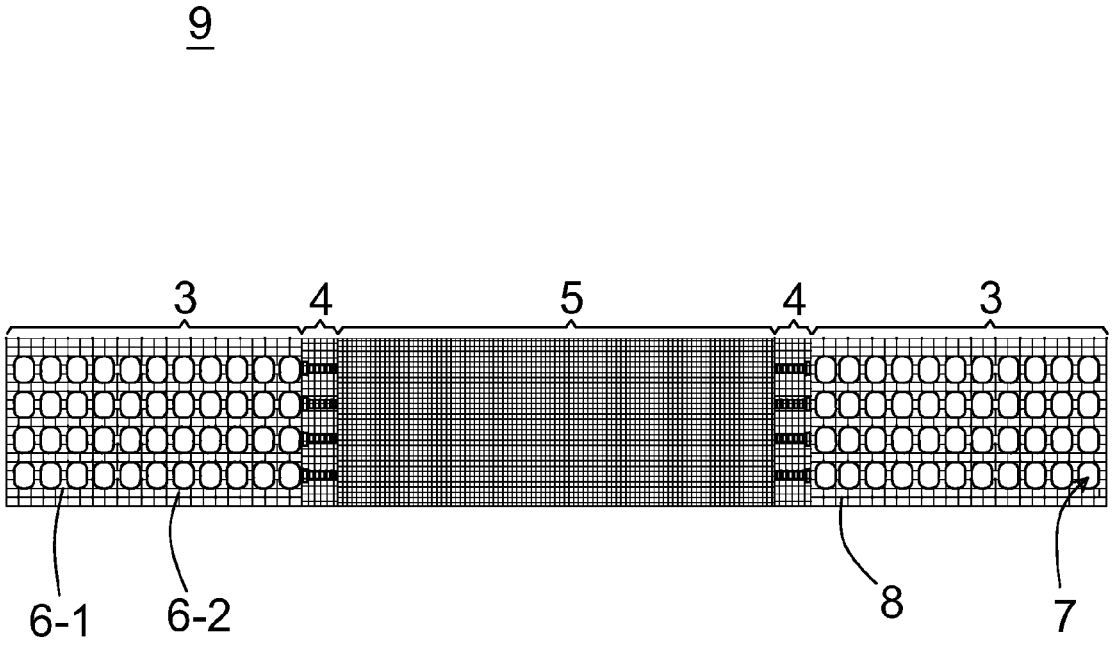
FIG. 5 shows a schematic view of a sweatband having granular pattern.
Figure 10:
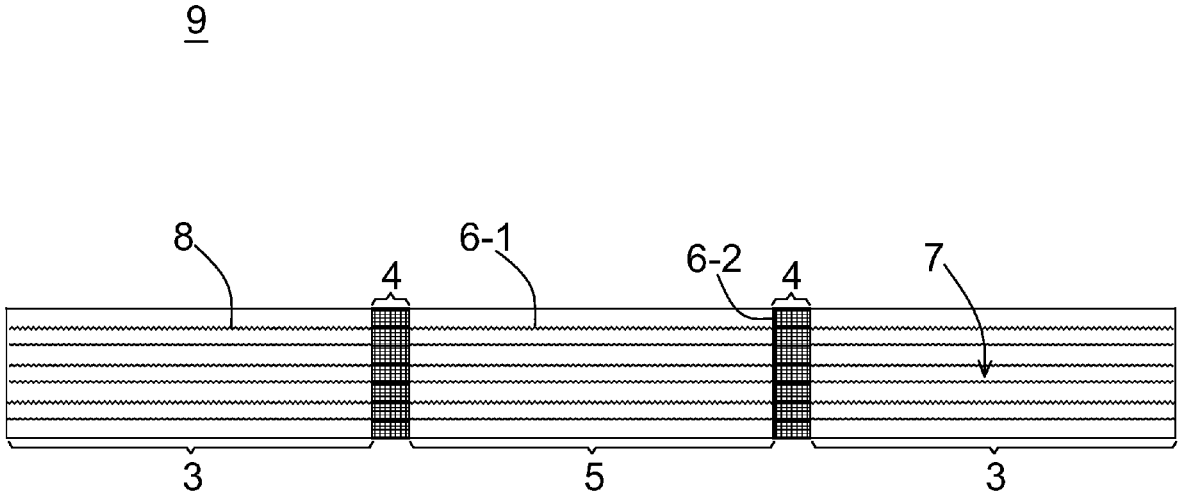
FIG. 10 shows a schematic view of the sweatband having stripe pattern.

As shown in FIG. 2 to FIG. 5, in one embodiment, the sweatband 9 includes three sections: a first section 3, a second section 4, and a third section 5. The first section 3 of the sweatband 9 includes at least one elastic fiber 8, warps 6-1, and wefts 6-2. The elastic fiber 8 and the warp 6-1 are woven in a warp direction, while the wefts 6-2 are woven in a weft direction. In this embodiment, the first section 3 is formed by weaving the elastic fibers 8, the warps 6-1, and the wefts 6-2 in any suitable weaving process. When the first section 3 is woven to a predetermined length such as reaching the start point of the second section 4, the weaving density is increased to form the second section 4, which has densely woven elastic fibers 8 and warps 6-1 without changing the weaving parameters of the wefts. Consequently, as shown in FIG. 3, even under a certain external force, the elastic fibers 8 are not easy to be pulled out from the second section 4. That is, the weaving density of the second section 4 is larger than the weaving density of the first section 3. As shown in FIG. 3, in one embodiment, the elastic fibers 8 are separated from the warps 6-1 and the wefts 6-2 to form the third section 5, which has only the woven warps 6-1 and the wefts 6-2. In other words, the third section 5 is woven in a manner similar to the second section 4 but lack of the elastic fibers 8. After the third section 5 is woven to a predetermined length, the separated elastic fiber 8 is rejoined and woven with the warps 6-1 and the wefts 6-2 so as to form another second section 4, as shown in FIG. 4. After the second section 4 is formed, the weaving process of the first section 3 can be repeated to form another first section 3. By continuously weaving as mentioned above, the sweatband 9 of the present invention can be formed. Therefore, the second section 4 is connected between the third section 5 and the first section 3 without any sewing portion. That is, the sweatband 9 is substantially sewing-free at the connections between the first section 3 and the second section 4 and between the second section 4 and the third section 5. This weaving process can not only reduce the materials but also decease the working hour to achieve comfortable and appealing effects. Furthermore, the weaving process can be applied to different sweatbands 9 as shown in FIG. 5 and FIG. 10.

Figure 13:
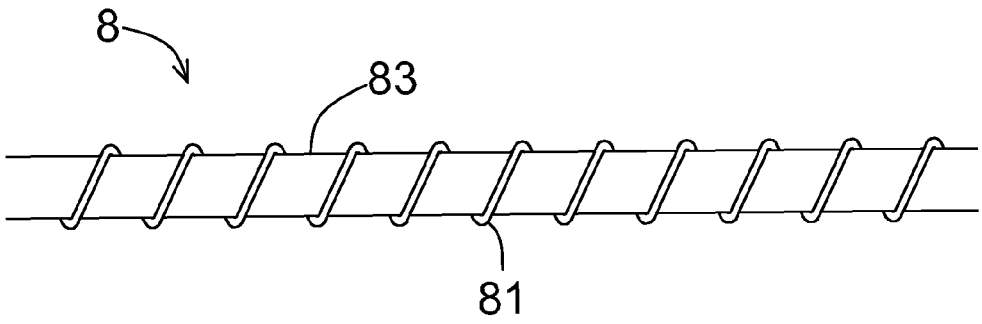
FIG. 13 shows a schematic structural view of the elastic fiber.

In the embodiments shown in FIG. 2 to FIG. 5, the elastic fiber 8 can include a nylon fiber and a polyethylene fiber, e.g. nylon 81 and polyethylene terephthalate 83. As shown in FIG. 13, the polyethylene terephthalate 83 serves as the core of the elastic fiber 8. The nylon 81 wraps around the polyethylene terephthalate 83 to form the elastic fiber 8, which has a yarn count preferably ranging from 10 to 25 and more preferably from 15 to 25. The stretchability of the elastic fiber 8 preferably ranges from 1.82 to 2.08 and more preferably from 1.95 to 2.01.

The present invention further provides a cap 10 having the sweatband 9 to satisfy the requirements of most people and to achieve economic, comfortable, and appealing effects. In addition, in the embodiments shown in FIG. 5 and FIG. 10, the weaving process can be modified to form various design patterns 7. The cap can not only have various design patterns 7 but also achieve economic, comfortable, and appealing effects.

Figure 6:
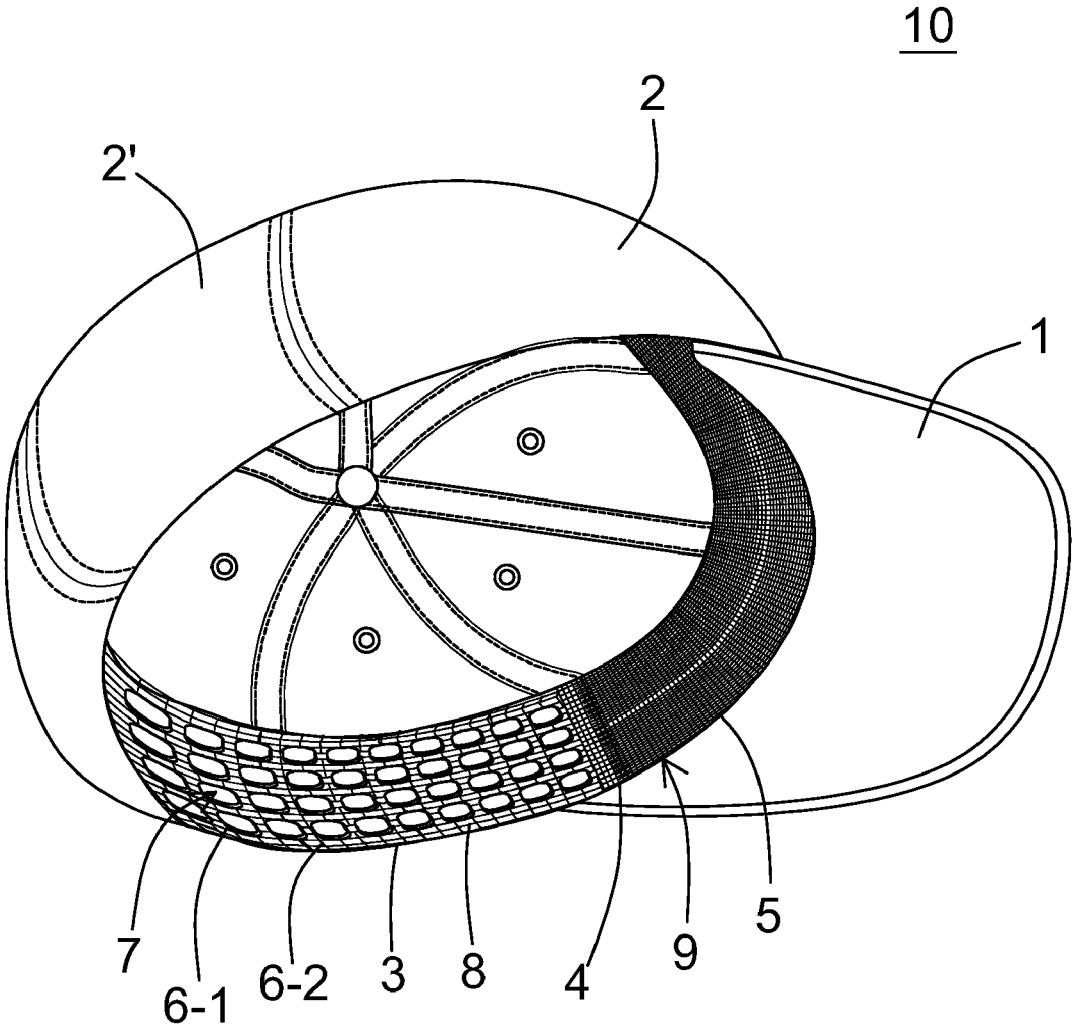
FIG. 6 shows a schematic view of an embodiment of the sweatband with granular pattern illustrating that the third section and the second section are connected to the bill portion, while the first section is connected to a portion of the body other than the bill portion.
Figure 7:
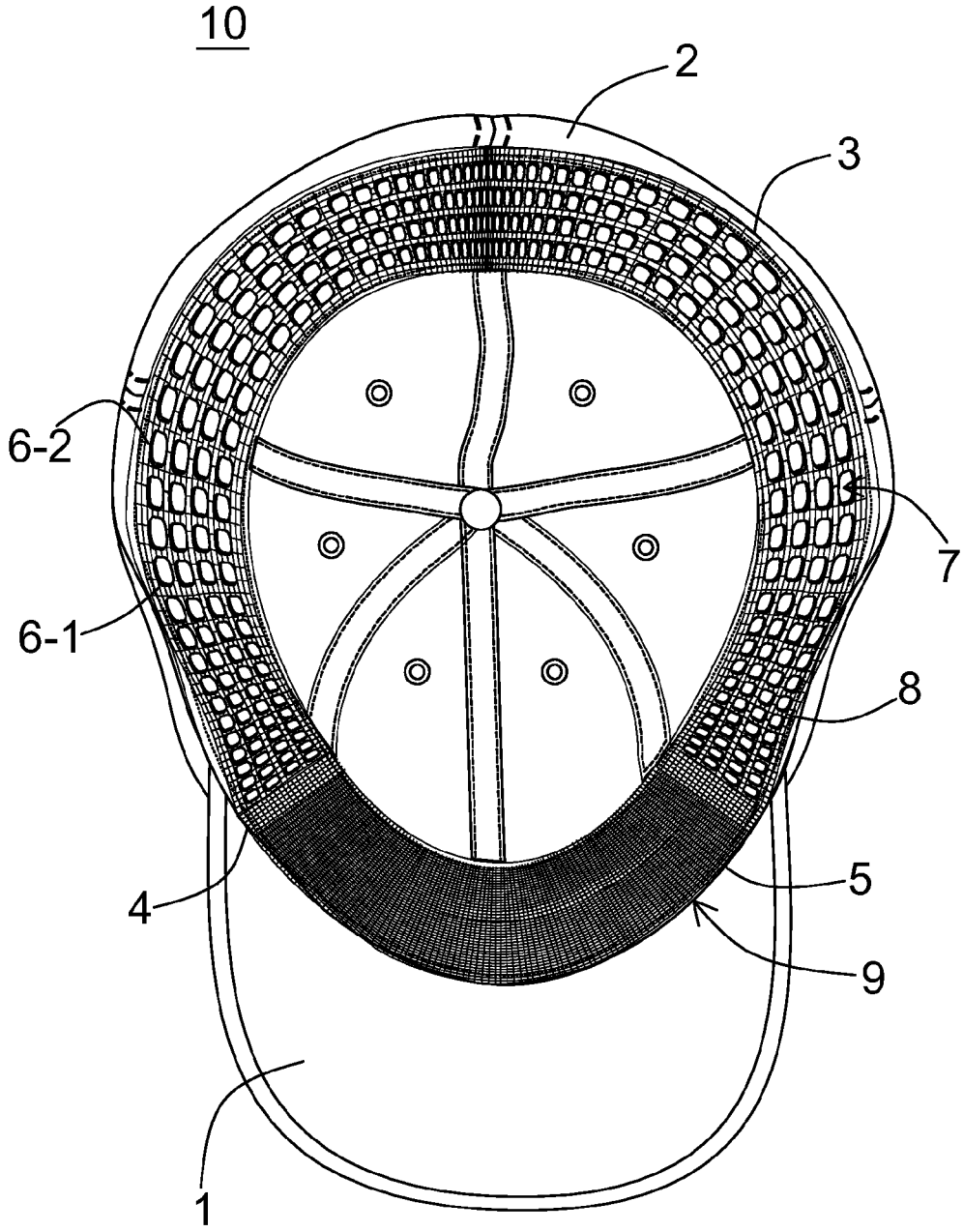
FIG. 7 shows a bottom view of the sweatband with granular pattern illustrating that the third section and the second section are connected to the bill portion, while the first section is connected to a portion of the body other than the bill portion.

As shown in FIG. 6 and FIG. 7, in one embodiment, the cap 10 includes a body 2 and a sweatband 9. The cap 10 can be any suitable headwear, such as sports or baseball cap, but not limited thereto. The body 2 can include a bill portion 1 and a plurality of gores 2'. The bill portion 1 is connected to at least one of the gores 2'. The sweatband 9 is connected to or sewn on the lower edge of the body 2. The sweatband 9 includes a first section 3, a second section 4, and a third section 5. The third section 5 is connected to the body 2 corresponding to the bill portion 1. However, in other embodiment, the third section 5 can be connected to the bill portion 1. The second section 4 is connected to the third section 5. The first section 3 is connected to a portion of the body 2 other than the bill portion 1 and also to the second section 4 to form the sweatband 9 including the third section 5, the second section 4, and the first section 3. The second section 4 is connected between the third section 5 and the first section 3 without a sewing portion or seam. In the embodiment, the third section 5 and the second section 4 can be connected to a portion of the body 2 corresponding to the bill portion 1. However, in another embodiment, the third section 5 and the second section 4 can be directly connected to the bill portion 1. The third section 5 is connected to the second section 4 without a sewing portion or seam. Thus, when the cap 10 is worn, the wearer will not feel uncomfortable caused by frictions of seam. In the embodiment, the sweatband 9 is sewn on the lower edge of the body 2. The bill portion 1 and the gores 2' are sewn to form the body 2 of the cap 10. The gore 2' connected to the bill portion 1 can be non-elastic fabric, while the other gores 2' can be elastic fabric. Such elastic fabric is preferably uniaxial elastic fabric; however, in other embodiment, the elastic fabric can be biaxial elastic fabric. In the embodiment, the third section 5 and the second section 4 are connected to a portion of the body 2 corresponding to the bill portion 1. Thus, the first section 3 is connected to a portion of the body 2 other than the bill portion 1. Besides, the second section 4 is connected between the third section 5 and the first section 3 without any sewing portion or seam. Therefore, the sweatband 9 makes the wearer feel more comfortable compared with the prior art. In the embodiment, the second section 4 and the first section 3 include at least one of elastic fibers 8. The third section 5 is free of elastic fibers 8. Since the second section 4 and the first section 3 contain the elastic fibers 8 in the warp direction, the second section 4 and the first section 3 are uniaxially stretchable. However, in other embodiments, the second section 4 and the first section 3 can contain elastic fibers 8 in both warp and weft directions, the second section 4 and the first section 3 are biaxially stretchable. Generally, the warp direction of the sweatband 9 is parallel to the lower edge of the cap 10; however, in other embodiments, the weft direction of the sweatband 9 can be parallel to the lower edge of the cap 10. In the embodiment shown in FIG. 5, the sweatband 9 includes a specific design pattern 7 such as granule, which is referred to "granular pattern".

Figure 8:
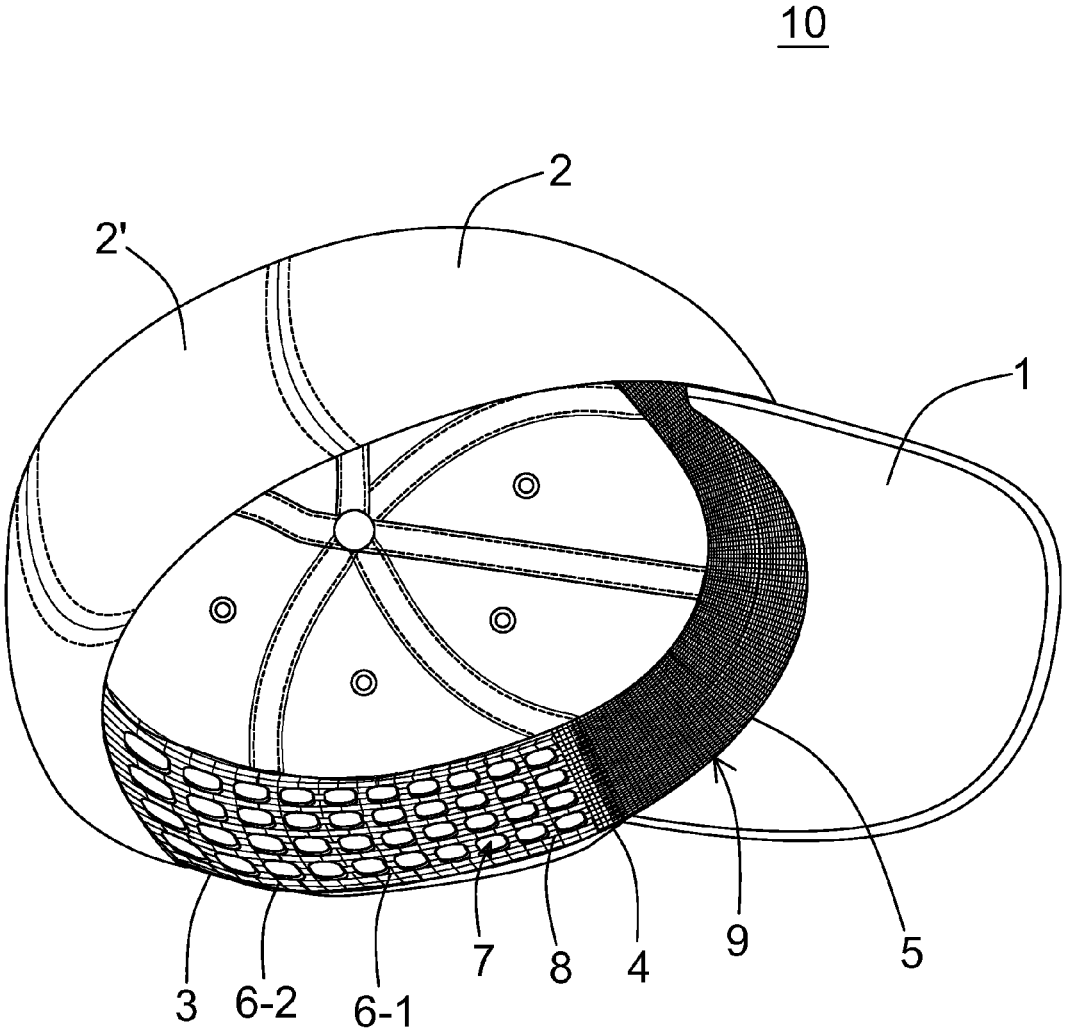
FIG. 8 shows a schematic view of another embodiment of the sweatband with granular pattern illustrating that the third section is connected to the bill portion, while the second section and the first section are connected to a portion of the body other than the bill portion.
Figure 9:
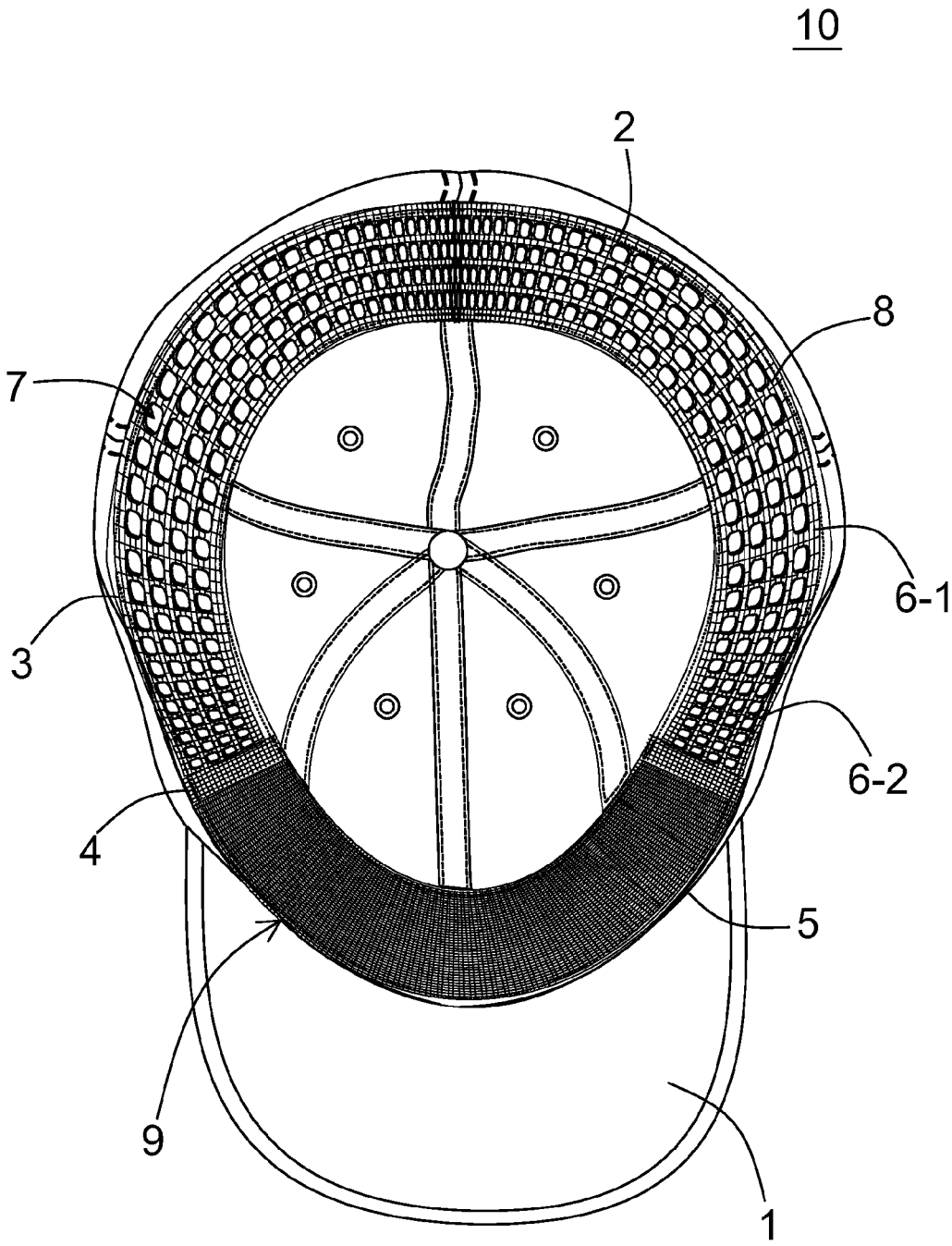
FIG. 9 shows a bottom view of the sweatband with granular pattern illustrating that the third section is connected to the bill portion, while the second section and the first section are connected to a portion of the body other than the bill portion.
Figure 11:
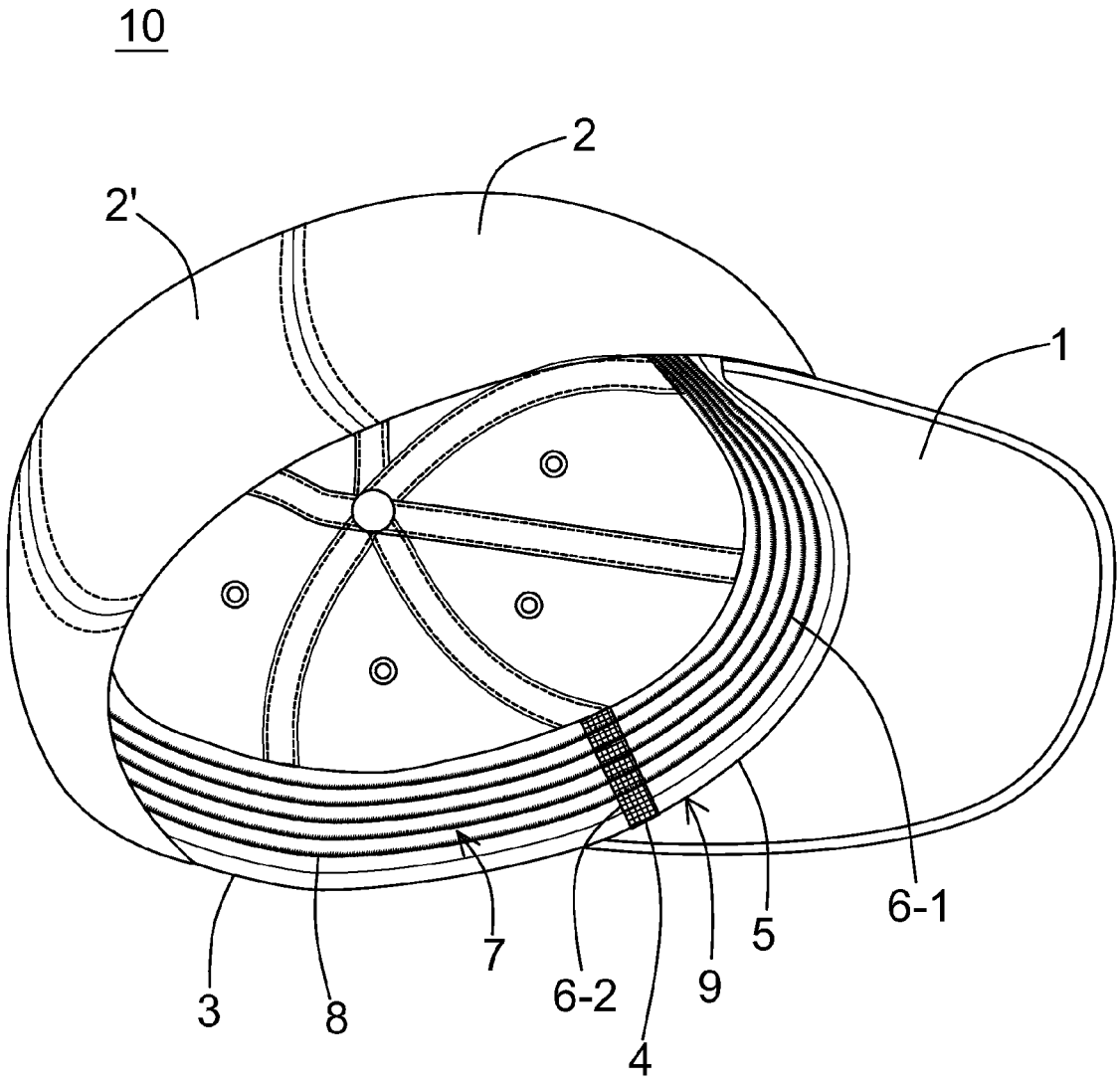
FIG. 11 shows a lateral view of the stripe-patterned sweatband connected to the body.
Figure 12:
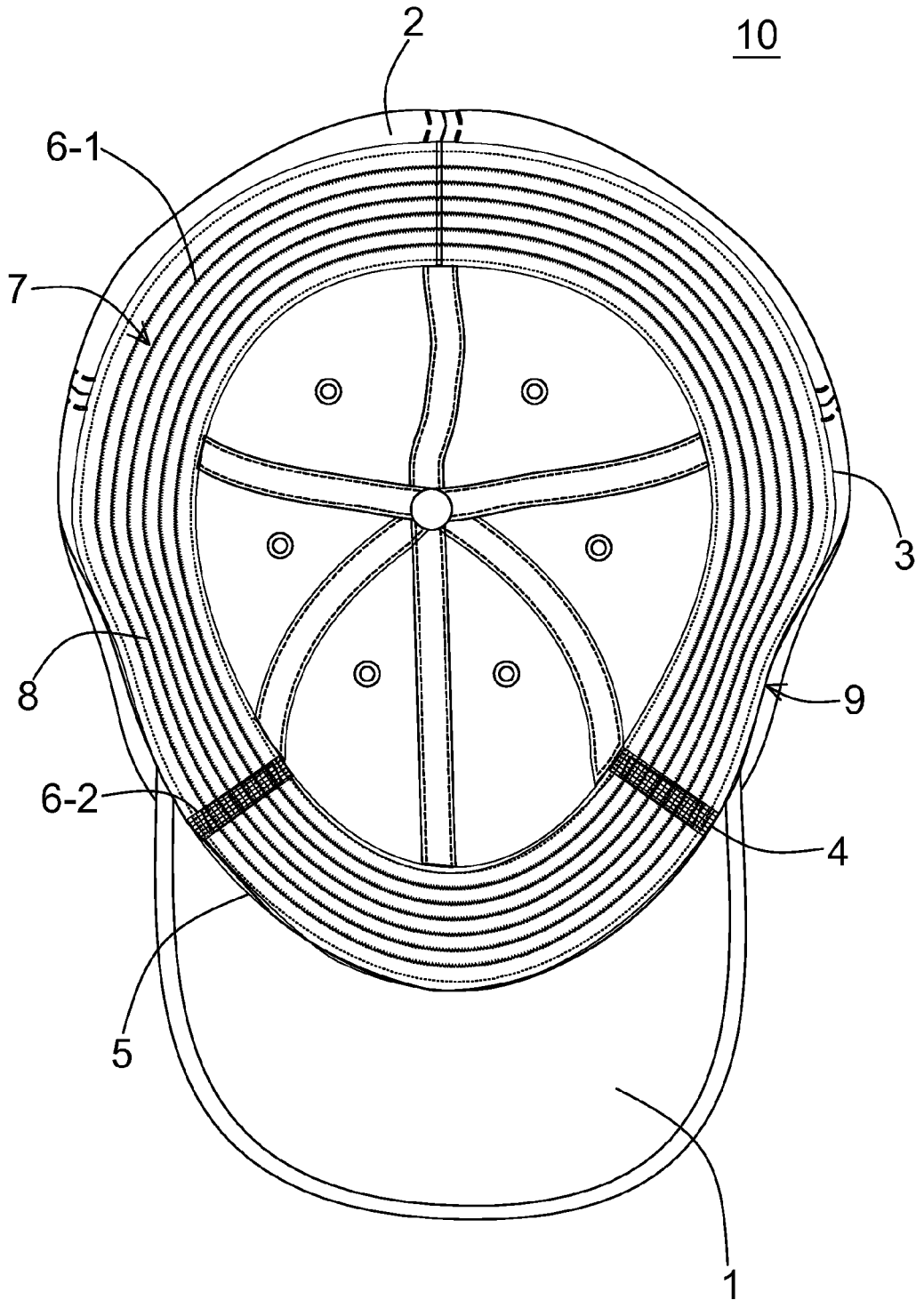
FIG. 12 shows a bottom view of the stripe-patterned sweatband connected to the body.

As shown in FIG. 8 and FIG. 9, in another embodiment, only the third section 5 is connected to a portion of the body 2 corresponding to the bill portion 1, and accordingly, the second section 4 and the first section 3 are connected to a portion of the body 2 other than the bill portion 1. In other embodiments, the cap 10 can have different designs, such as the embodiments of FIG. 11 and FIG. 12, which may have the above-mentioned sweatband 9 or different types of sweatband 9 made by a similar process. In the embodiments shown in FIG. 11 and FIG. 12, the sweatband 9 includes a specific design pattern 7 as stripes, which is referred to "stripe pattern". Additional processes can be performed on the sweatband 9 in other embodiments. For example, additional processes such as printing or sewing the brand logo or company name can be performed on the third section 5 of the sweatband 9 for advertisement.

The manufacturing process of the sweatband of the present invention can include the following steps: providing at least one warp, at least one weft, and at least one elastic fiber; weaving the elastic fibers with the warps and the wefts in a warp direction to form a first section having a first weaving density; weaving the elastic fibers with the warps and the wefts in the warp direction to form a second section having a second weaving density less than the first weaving density; and separating the elastic fibers to weave the warps and the wefts to form a third section. The second section is connected between the first section and the third section without a sewing portion or seam. Furthermore, the process further includes rejoining the elastic fibers with the wafts and the wefts to form another second section after the third section is formed. The process further includes a step of cutting off the separated elastic fibers from the third section when the sweatband is completed. Therefore, the sweatband can be formed in a continuously weaving process without a sewing portion or seam among the first section, the second section, and the third section.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A process for manufacturing a sweatband, the process comprising:

providing at least a warp, at least a weft, and at least an elastic fiber, wherein the warp, the weft, and the elastic fiber are separate; the warp and the weft are non-elastic fibers;

weaving the elastic fiber, the warp, and the weft together in a warp direction to form a first section having a first weaving density, wherein the elastic fiber weaved extends in the warp direction;

weaving the elastic fiber, the warp and the weft together in the warp direction to form a second section having a second weaving density, wherein the elastic fiber weaved extends in the warp direction;

separating the elastic fiber from the warp and the weft, and weaving the warp and the weft together in the warp direction to form a third section;

rejoining the elastic fiber with the warp and the weft to form a fourth section after the third section is formed;

cutting off the separated elastic fiber between the second section and the fourth section; and weaving the elastic fiber, the warp and the weft together in the warp direction to form a fifth section after the fourth section is formed; wherein the fifth section and the fourth section are different in weaving density;

wherein the second weaving density of the second section is larger than the first weaving density of the first section, and the second section is connected between the first section and the third section in the warp direction without a sewing portion.

2. The process of claim 1, wherein the fourth section is another second section and has the second weaving density, the fifth section is another first section and has the first weaving density.

3. The process of claim 1, further comprising repeatedly forming another second section, another third section, another fourth section and another fifth section after the fifth section is formed.

4. The process of claim 1, wherein providing at least an elastic fiber further includes providing a polyethylene fiber and a nylon fiber, the polyethylene fiber serves as a core of the elastic fiber, the nylon fiber wraps around the polyethylene fiber to form the elastic fiber, the elastic fiber has a yarn count ranging between 10 and 25 and a stretchability ranging between 1.82 and 2.08.

5. A process for manufacturing a sweatband, the process comprising:

providing at least a warp, at least a weft, and at least an elastic fiber, wherein the warp, the weft, and the elastic fiber are separate; the warp and the weft are non-elastic fibers;

weaving the elastic fiber, the warp, and the weft together in a warp direction to form a first section having a first weaving density, wherein the elastic fiber weaved extends in the warp direction;

continuously weaving the elastic fiber, the warp and the weft together in the warp direction to form a second section having a second weaving density after the first section is formed; and separating the elastic fiber from the warp and the weft, and continuously weaving the warp and the weft together in the warp direction to form a third section after the second section is formed;

wherein the second weaving density of the second section is larger than the first weaving density of the first section, and the second section is connected between the first section and the third section in the warp direction without a sewing portion.

6. The process of claim 5, wherein providing at least an elastic fiber further includes providing a polyethylene fiber and a nylon fiber, the polyethylene fiber serves as a core of the elastic fiber, the nylon fiber wraps around the polyethylene fiber to form the elastic fiber, the elastic fiber has a yarn count ranging between 10 and 25 and a stretchability ranging between 1.82 and 2.08.

7. The process of claim 5, further comprising rejoining the elastic fiber with the warp and the weft to continuously form a fourth section after the third section is formed.

8. The process of claim 5, further comprising cutting off the separated elastic fiber from the third section.

9. The process of claim 5, further comprising repeating at least one of the steps of forming the first, the second, and the third sections.

10. A process for manufacturing a cap, the process comprising:

manufacturing a sweatband by the process of claim 5;

providing a bill portion and a body composed of a plurality of gores;

connecting the bill portion to at least one of the gores of the body; and connecting the sweatband to at least one of the body and the bill portion.

11. The process of claim 10, wherein connecting the sweatband to at least one of the body and the bill portion further comprises connecting the sweatband to or sewing the sweatband on a lower edge of the body.

12. The process of claim 10, wherein connecting the sweatband to at least one of the body and the bill portion further comprises connecting the third section to the bill portion and connecting the first section to the body.

13. The process of claim 10, wherein connecting the sweatband to at least one of the body and the bill portion further comprises connecting the third section to a lower edge of the body corresponding to the bill portion.

14. The process of claim 12, wherein connecting the sweatband to at least one of the body and the bill portion further comprises connecting the second section to the bill portion.

15. The process of claim 13, wherein connecting the sweatband to at least one of the body and the bill portion further comprises connecting the second section to the lower edge of the body corresponding to the bill portion.

16. The process of claim 10, wherein providing the body further comprises providing the body composed of at least a gore made of non-elastic fabric and at least a gore made of elastic fabric.

17. The process of claim 16, wherein connecting the bill portion to at least one of the gores of the body further comprises connecting the bill portion to the gore made of non-elastic fabric.

* * * * *